US006106237A

United States Patent [19]

Dominoni et al.

[11] Patent Number: 6,106,237

[45] Date of Patent: Aug. 22, 2000

[54] GETTER PUMP WITH ONE-PIECE FRAME SUPPORTING NONEVAPORABLE GETTER ELEMENTS

[75] Inventors: Danilo Dominoni, Ossona; Roberto Giannantonio, Gallarate, both of Italy

[73] Assignee: Saes Getters, S.P.A., Lainate, Italy

[21] Appl. No.: 09/027,724

[22] Filed: Feb. 23, 1998

[30] Foreign Application Priority Data

Feb. 24, 1997 [IT] Italy ..... MI97A0393

[51] Int. Cl.[7] ..... F04B 37/02

[52] U.S. Cl. ..... 417/51; 417/48; 417/49

[58] Field of Search ..... 417/51, 48, 49, 417/50

[56] References Cited

U.S. PATENT DOCUMENTS

| | | | |
|---|---|---|---|
| 4,137,012 | 1/1979 | della Porta et al. | 417/51 |
| 5,320,496 | 6/1994 | Manini et al. | 417/51 |
| 5,324,172 | 6/1994 | Manini et al. | 417/51 |

FOREIGN PATENT DOCUMENTS

| | | | |
|---|---|---|---|
| 41 10 588 A1 | 10/1992 | Germany | 41/12 |
| 4-5480 | 1/1992 | Japan | 37/2 |
| WO 96/17171 | 6/1996 | WIPO | 37/2 |

*Primary Examiner*—Timothy S. Thorpe
*Assistant Examiner*—Timothy P. Solak
*Attorney, Agent, or Firm*—Hickman Stephens Coleman and Hughes, LLP

[57] ABSTRACT

A getter pump includes a one-piece, substantially U-shaped frame having a bottom, a first sidewall, and a second sidewall opposing the first sidewall. The first and second sidewalls each have a plurality of slots formed therein. A plurality of getter elements are housed in the frame. Each of the getter elements is disposed in one of the slots in the first sidewall and a corresponding slot in the second sidewall. A heating member for heating the getter elements to their operating temperature is disposed in the frame. A preformed sheet of metal for use in forming a component of a getter pump has a top surface, a bottom surface, and discontinuous perforations formed therein to define a generally rectangular frame section. This frame section is connected to the remainder of the sheet by breakaway tabs and has a pair of folding lines formed therein to define a middle section and opposing outer sections. Each of the opposing outer sections has a plurality of slots formed therein. A method of forming a getter pump component is also described.

17 Claims, 5 Drawing Sheets

GETTER PUMP WITH ONE-PIECE FRAME SUPPORTING NONEVAPORABLE GETTER ELEMENTS

CLAIM FOR PRIORITY

This patent application claims priority under 35 U.S.C. § 119 from Italian Patent Application Serial No. MI97A 000393, filed Feb. 24, 1997, which is incorporated herein by reference.

BACKGROUND OF THE INVENTION

The present invention relates generally to getter pumps and, more particularly, to a getter pump in which a plurality of getter elements are housed in a frame having opposing sidewalls with slots formed therein for receiving the getter elements, a method of forming a getter pump component, and a preformed sheet of metal for use in forming components of a getter pump.

In the field of vacuum technology so-called "getter pumps" have been known for several decades. Getter pumps are static devices, i.e., devices which operate without moving parts. The ability to operate without moving parts provides getter pumps with at least two significant advantages. First, lubrication is not required. This is important in applications related to the semiconductor industry because lubricants can contaminate the chamber to be evacuated. Second, getter pumps do not transmit any undesirable vibrations to the system to which they are connected.

The operation of getter pumps is based on the chemisorption of all gases, except for noble gases, by nonevaporable getter materials, which are sometimes referred to as "NEG materials." The primary NEG materials are alloys based on zirconium and titanium which may include elements such as aluminum, vanadium, iron, nickel, or other transitional elements, or combinations thereof. Commercially available NEG materials produced by SAES Getters S.p.A. of Milan, Italy, the assignee of the present application, include the alloys sold under the trade names St 101® and St 707™. The St 101® alloy has a composition of 84 wt % Zr and 16 wt % Al. The St 707™ alloy has a composition of 70 wt % Zr, 24.6 wt % V, and 5.4 wt % Fe.

The active members of getter pumps are referred to as "getter elements." One known method for forming getter elements involves adhering, e.g., by lamination, NEG material in powder form to a suitable metal support. Getter pumps including getter elements formed in accordance with this method are disclosed in U.S. Pat. No. 4,137,012 to della Porta et al., which is assigned to SAES Getters S.p.A., and Japanese Laid-Open Patent Application (Kokai) No. 4-5480. More recent getter pumps have included getter elements formed by sintering NEG material powders as disclosed, for example, in U.S. Pat. No. 5,320,496 to Manini et al. and U.S. Pat. No. 5,324,172 to Manini et al., both of which are assigned to SAES Getters S.p.A.

Regardless of the manner in which the getter elements are formed, it is necessary to keep the getter material at temperatures of at least 400° C. during operation to ensure optimal performance of the getter material. Furthermore, NEG material requires a starting "activation" treatment at temperatures of at least 400° C. and up to 900° C. over 10–30 minute periods.

Getter elements may be disposed within a getter pump in a variety of ways, e.g., by filling the getter pump with sintered pills obtained from NEG material powders. In known getter pumps the getter elements are preferably mounted on a support having a heating member mounted thereon or nearby to heat the getter elements to the above-mentioned temperatures. Although different types of heating members may be used, infrared lamps are especially advantageous because they are easy to replace, which is important because the life of the heating element is short relative to that of the getter elements. The getter elements also may be regenerated and replaced and, therefore, the getter pump must be easy to disassemble and to reassemble.

In known getter pumps NEG material disks or plates are arranged within the pump with an optimized geometry. In fact, the performance of a getter pump, and in particular its gas sorption rate, depends upon the geometrical relationship between the getter elements. For example, in the case of parallel getter elements, there is an optimum range of spacing with which a maximum gas sorption rate is obtained. At a spacing above or below the optimum spacing, the gas sorption rate decreases. The gas sorption rate further depends upon the effectiveness of the heating member in heating the getter elements, which in turn depends upon geometrical factors. The spacing tolerance in the geometry of a getter pump is therefore a primary factor affecting the performance of the pump. To obtain the desired geometry of the getter elements, metal bearings fastened to the inner walls of the pump body are arranged within a getter pump. This complicates the pump manufacturing process because it requires the use of mechanical assemblies (with screws, etc.) or welding a plurality of metal members. As a result, the tolerances of the geometry of the getter elements provided for in the pump design may be lost during the mechanical assembly stage of the manufacturing process. Further, even when the pumps are manufactured to precise tolerances, problems with tolerances may arise during the life of the pump because of adjustments which occur when the pumps are thermally cycled from room temperature to their operating temperature, which is generally at least 400° C. Tolerance problems also may occur during moving or transporting of the pumps.

In view of the foregoing, there is a need for a getter pump which includes a supporting framework which enables the getter elements to be assembled thereon precisely in a quick and safe operation.

SUMMARY OF THE INVENTION

Broadly speaking, the invention fills this need by providing a getter pump which is easy to assemble, which reliably maintains the getter elements in an optimized geometric configuration, and which effectively thermally shields the getter elements. The invention also provides a method of forming a getter pump component and a preformed sheet of metal for use in forming a component of a getter pump.

In one aspect of the invention, a getter pump is provided. The getter pump includes a frame having a bottom, a first sidewall, and a second sidewall opposing the first sidewall. The first and second sidewalls each have a plurality of slots formed therein. A plurality of getter elements are housed in the frame. Each of the getter elements is disposed in one of the slots in the first sidewall and a corresponding slot in the second sidewall. A heating member for heating the getter elements to their operating temperature is disposed in the frame.

The getter pump may further include first and second contoured strips for at least partially shielding exposed sides of the getter elements protruding through the slots in the first and second sidewalls, respectively. These first and second contoured strips may be fastened to outer surfaces of the first and second sidewalls, respectively. If desired, the getter pump also may include at least one stiffening strip fastened transversely to the first and second sidewalls. The heating member is preferably an infrared lamp and is preferably mounted on the bottom of the frame. The frame is preferably comprised of stainless steel.

In a preferred embodiment, the getter pump includes a one-piece, substantially U-shaped frame having a bottom, a first sidewall extending upwardly from the bottom, and a second sidewall extending upwardly from the bottom and opposing the first sidewall. In this preferred embodiment, the first and second sidewalls are formed by folding a single metal sheet along a pair of spaced apart folding lines formed in the sheet and have a plurality of substantially parallel slots formed therein. Each of the getter elements is a rectangular plate of nonevaporable getter material and each of these getter elements is disposed in one of the slots in the first sidewall and a corresponding slot in the second sidewall such that the getter elements are substantially parallel to one another. Further, the getter elements preferably have a length larger than the width of the bottom of the frame so that sides of the getter elements protrude through the slots in the first and second sidewalls.

In one preferred embodiment, the first and second contoured strips each have integrally stepped ends. The integrally stepped ends of the first and second contoured strips are spot welded to the first and second sidewalls, respectively. In another preferred embodiment, ends of the first contoured strip have protruding tangs inserted in openings in the first sidewall, and ends of the second contoured strip have protruding tangs inserted in openings in the second sidewall. In this latter preferred embodiment, at least one stiffening strip is integrally formed with the first and second contoured strips. The at least one stiffening strip extends transversely between the first and second contoured strips and has folding lines formed therein along which the first and second contoured strips are folded.

In another aspect of the invention, a method of forming a getter pump component is provided. In this method a preformed sheet of metal having a getter pump component defined therein by discontinuous perforations is first provided. The getter pump component preferably has at least one folding line formed therein to enable the getter pump component to be folded into a desired shape. Next, the getter component is detached from the sheet of metal. Finally, the getter pump component is folded along the at least one folding line to obtain the desired shape. The getter pump component is preferably connected to the remainder of the preformed sheet of metal by breakaway tabs, and is preferably is detached from the remainder by breaking the breakaway tabs.

In a further aspect of the invention, a preformed sheet of metal for use in forming a component of a getter pump is provided. This preformed sheet of metal has a top surface, a bottom surface, and discontinuous perforations formed therein to define a generally rectangular frame section. This frame section is connected to the remainder of the sheet by breakaway tabs. Further, this frame section has a pair of folding lines formed therein to define a middle section and opposing outer sections. Each of the opposing outer sections has a plurality of slots formed therein. The slots in the opposing outer sections are preferably substantially parallel to one another. If desired, the discontinuous perforations may further define two rectangular strip sections that are connected to the remainder of the sheet by breakaway tabs. Preferably, each end of these two rectangular strip sections has two folding lines formed therein, with one of the folding lines being formed in the top surface of the sheet and another of the folding lines being formed in the bottom surface of the sheet.

The getter pump of the present invention is compact, easy to assemble, and reliably maintains the getter elements in an optimized geometric configuration without the use of mechanical assemblies or substantial welding which may complicate the assembly process. Further, the U-shape of the frame is advantageous because it helps to maintain the getter elements at their optimum temperature by serving as an effective thermal shield for preventing heat losses to the outside and by directing, e.g., by reflection, a maximum amount of radiation from the heating member, e.g., an infrared lamp, onto the getter elements.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE PREFERRED EMBODIMENTS

Reference will now be made to the present preferred embodiments of the invention, examples of which are illustrated in the accompanying drawings.

Figure 1A:
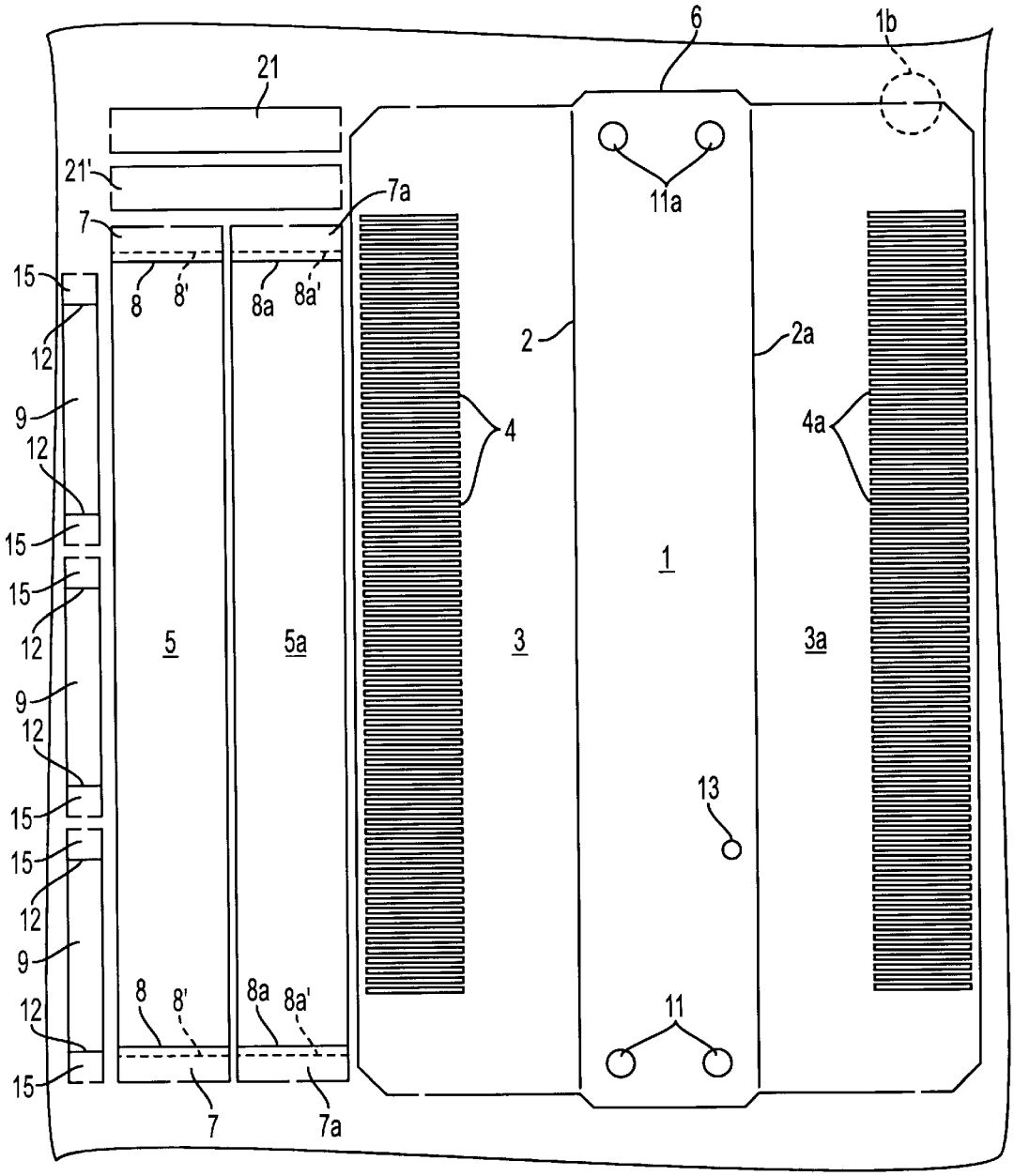
FIG. 1*a* shows a first preformed sheet of metal having slots, holes, folding lines, and perforations formed therein for use in forming a getter pump in accordance with one embodiment of the invention.

In one aspect of the invention, a preformed sheet of metal for use in forming components of a getter pump is provided. FIG. 1 shows a preformed sheet of metal in accordance with one embodiment of the invention. The preformed sheet of metal is preferably comprised of stainless steel but those skilled in the art will recognize that any suitable metal may be used. The preformed sheet of metal has a generally rectangular frame section including substantially rectangular middle strip 1, sides of which are defined by folding lines 2, 2*a*, and two substantially rectangular side strips 3, 3*a* defined therein. A series of slots 4, 4*a* are formed in side strips 3, 3*a*, respectively, in the outermost region of each strip, i.e., away from fold lines 2, 2*a*, and proximate to the outer edge of each strip. As shown in FIG. 1, each of slots 4, 4*a* is substantially parallel to one another, has the same length and width, and is equally spaced apart from one another by a distance that is substantially the same as the width of each slot. Middle strip 1 has holes 11 and 11*a* formed therein for fastening a getter pump formed from the sheet of metal to a supporting body and a hole 13 formed therein to permit insertion of a thermocouple into such a getter pump.

Figure 1B:
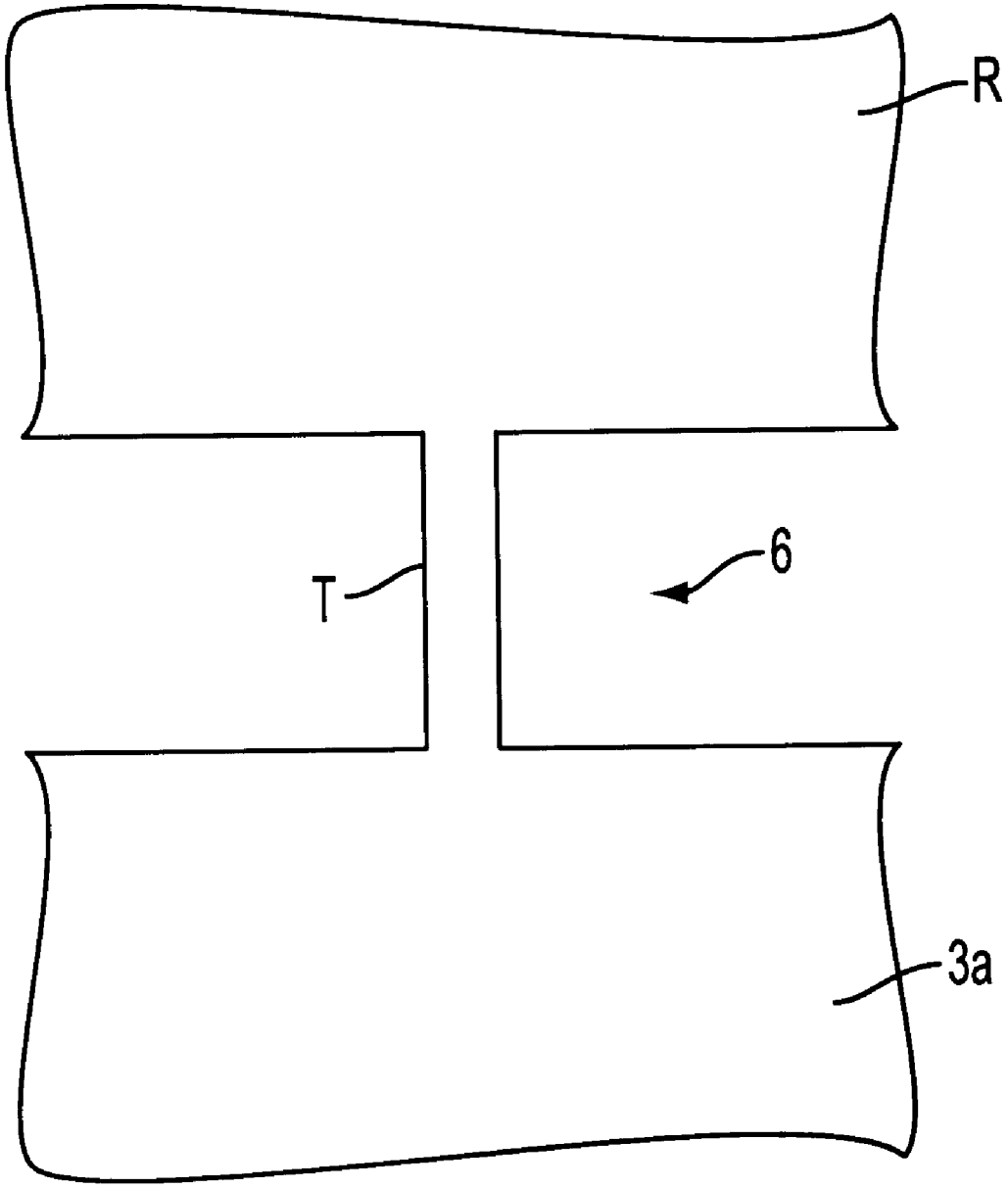
FIG. 1*b* is an enlarged view of region 1*b* indicated by the dashed circle in FIG. 1*a* which shows a breakaway tab which connects a getter pump component, which is defined in the first preformed sheet of metal by a discontinuous perforation, to the remainder of the sheet.

The outline of the frame section including strips 1, 3, and 3*a* is defined in the sheet by a discontinuous perforation, i.e., an incision or cut line, which is preferably formed within narrow tolerances by etching. As shown in FIG. 1, discontinuous perforation 6 outlines the frame section including strips 1, 3, and 3*a*. Those skilled in the art will appreciate that perforation 6 also may be formed within narrow tolerances by other known techniques, e.g., laser cutting. The perforation 6 is rendered discontinuous by breakaway tabs which connect the frame section to the remainder of the sheet. The breaks in perforation 6 shown in FIG. 1 indicate preferred locations for the breakaway tabs. As shown in FIG. 1*b*, breakaway tab T interrupts perforation 6 and connects strip 3*a* to the remainder R of the sheet. The breakaway tabs are preferably dimensioned to break upon the application of a limited manual force so that the frame section can be easily removed for use in the manufacture of a getter pump, as will be described in detail later. The slots 4, 4*a* in side strips 3, 3*a*, respectively, and holes 11, 11*a*, and 13 in middle strip 1 also are preferably formed by etching. Folding lines 2, 2*a*, as well as other folding lines which will be described later, are preferably formed by an etching process controlled to remove only that portion of the sheet thickness needed to facilitate folding of the sheet, e.g., one-half the sheet thickness.

In addition to the frame section, the sheet of metal shown in FIG. 1 also has two identical rectangular strips 5, 5*a* defined therein by a discontinuous perforation interrupted by breakaway tabs so as to be readily detachable from the sheet as described above for the frame section. Strips 5, 5*a* are preferably located close to the outline for the frame section to minimize waste. Strip 5 has a pair of folding lines 8, 8' at each end thereof and strip 5*a* has a pair of folding lines 8*a*, 8*a*' at each end thereof. Each pair of folding lines 8, 8' separates strip 5 from end strips 7 and each pair of folding lines 8*a*, 8*a*' separates strip 5*a* from end strips 7*a*. The major dimension of each end strip 7 and end strip 7*a* corresponds to the width of strips 5, 5*a*, respectively. To form a getter pump component, the foldings along each pair of folding lines 8, 8' and each pair of folding lines 8*a*, 8*a*' have to be made in opposite directions to form integrally stepped ends, as will be described later. Accordingly, the folding lines composing these pairs are provided on opposite surfaces of the sheet. The folding lines formed in the hidden, i.e., bottom, surface of the sheet are depicted as dashed lines in FIG. 1. The width of each strip 5, 5*a* is slightly greater than the length of slots 4, 4*a* formed in side strips 3, 3*a*, respectively. Further, the length of each strip 5, 5*a* is at least the same as the length of the region in which slots 4, 4*a* are provided on strips 3, 3*a*, respectively.

With reference to FIG. 1, three additional strips 9 are defined in the sheet of metal by respective discontinuous perforations interrupted by breakaway tabs, as described above. Strips 9 are preferably situated in close proximity to strip 5 to minimize waste. Folding lines 12 are provided in each strip 9 to define a substantially square piece 15 at each end of each strip 9. The length of each strip 9 is such that the distance between the folding lines 12 at each end thereof is substantially the same as the width of middle strip 1 of the frame section. Lastly, two strips 21, 21' are defined in the sheet of metal at one end of strips 5, 5*a*, preferably close to those ends to minimize waste.

Figure 2A:
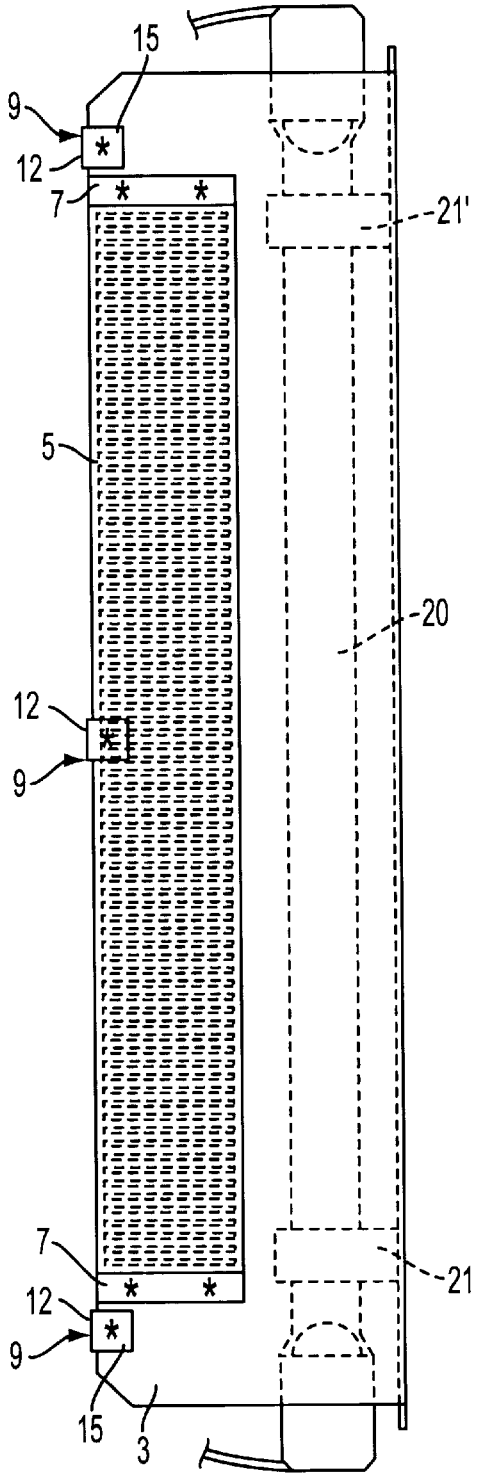
FIG. 2*a* shows a side view of a getter pump in accordance with one embodiment of the invention obtained from the preformed sheet of metal shown in FIG. 1.
Figure 2B:
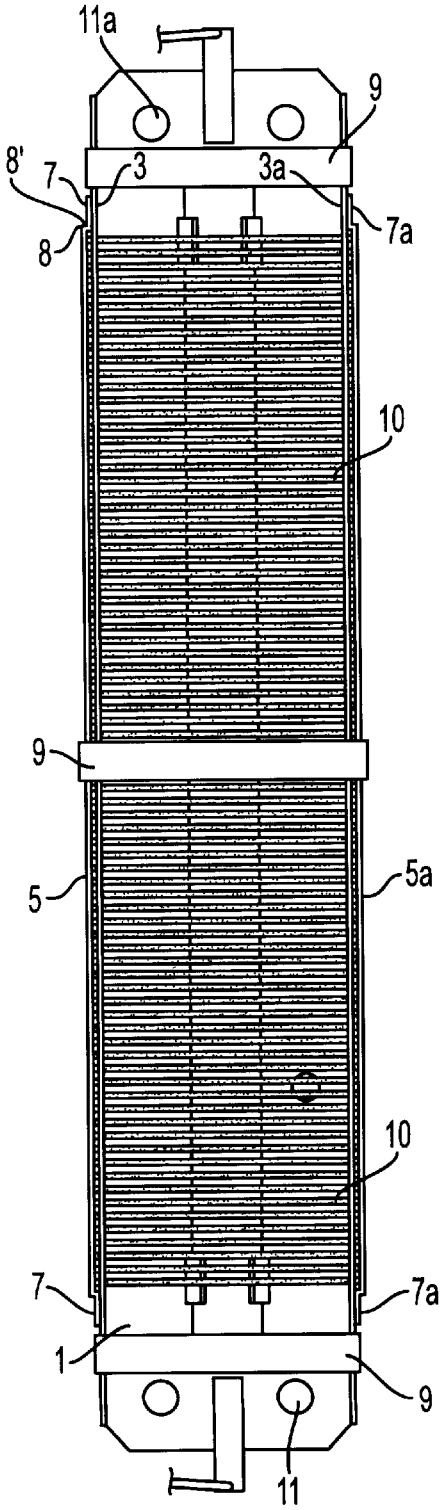
FIG. 2*b* shows a top plan view of a getter pump in accordance with one embodiment of the invention obtained from the preformed sheet of metal shown in FIG. 1.

FIGS. 2*a* and 2*b* show side and top views, respectively, of a getter pump formed in accordance with one embodiment of the invention which is wholly assembled using the preformed sheet of metal shown in FIG. 1, a number of getter elements in the form of rectangular plates of a known nonevaporable getter material, e.g., the St 101® alloy described above, and a heating member. A preferred process by which the getter pump shown in FIGS. 2*a* and 2*b* may be assembled is as follows.

First, heating member 20 is fastened to middle strip 1 of the frame section (while the frame section is still attached to the preformed sheet of metal) using strips 21, 21' as support members. Heating member 20 is preferably an infrared lamp, however, other types of heaters may be used. Strips 21, 21' may be fastened to middle strip 1 by any suitable technique, e.g., spot welding. Next, the frame section including strips 1, 3, and 3*a* is detached from the preformed sheet of metal by breaking the breakaway tabs connecting the frame section to the rest of the sheet, e.g., by applying manual force. The frame section is then folded along folding lines 2, 2*a* to form a substantially U-shaped frame, with middle strip 1 forming the bottom of such frame and strips 3, 3*a* bent at approximately 90° with respect to the bottom to form opposing sidewalls of such frame.

After the U-shaped frame has been formed, strips 5, 5*a* are detached from the sheet by breaking the breakaway tabs connecting the strips to the rest of the sheet. Each strip 5, 5*a* is then folded to form a contoured strip having integrally stepped ends. This may be accomplished by, in the case of strip 5, folding each end thereof 90° in a first direction along folding line 8 and then 90° in the opposite direction along folding line 8'. Next, one of folded strips 5, 5*a* is affixed to an outer surface of one of the sidewalls 3, 3*a*. This may be accomplished by, in the case of strip 5 being affixed to sidewall 3, spot welding end strips 7 to sidewall 3 at the locations indicated by an * in FIG. 2*a*. As a result, end strips 7 are adhered to the outer surface of sidewall 3, while the long segment of strip 5 is parallel to and spaced apart from the outer surface of sidewall 3 by a distance equal to the length of the short segment between folding lines 8, 8'.

At this point, getter elements 10 in the form of rectangular plates are inserted in the slots of the sidewalls. It will be appreciated by those skilled in the art that this means that the thickness of getter elements 10 must be slightly smaller than the width of slots 4, 4*a*. By way of example, if strip 5 is affixed to sidewall 3, then one of the shorter sides of getter element 10 is first inserted into one of slots 4*a* of sidewall 3*a*, i.e., the sidewall without the strip affixed thereto, and then inserted into the corresponding slot 4 of sidewall 3, i.e., the sidewall with the strip affixed thereto. The width of the bottom of the frame, which corresponds to the width of middle strip 1, is selected to be slightly smaller than the width of getter elements 10. Consequently, getter elements 10 protrude slightly through slots 4, 4*a* in sidewalls 3, 3*a*, respectively. Further, the length along which slots 4, 4*a* are provided in sidewalls 3, 3*a*, respectively, is preferably at least the same as the length of the hot segment of heating member 20. Once all the slots 4, 4*a* are filled with getter elements 10, the remaining strip is affixed to the sidewall without a strip affixed thereto. By way of example, if strip 5 is affixed to sidewall 3 before insertion of getter elements 10, then strip 5*a* is attached to sidewall 3*a* after insertion of getter elements 10.

When one of strips 5, 5*a* is affixed to each of sidewalls 3, 3*a*, strips 5, 5*a* securely retain getter elements 10 within slots 4, 4*a* of sidewalls 3, 3*a*, respectively. This configuration enables getter elements 10 to be stably and reliably kept in the position that corresponds to the optimum geometric configuration of the getter pump. As shown in FIGS. 2*a* and 2*b*, getter elements 10 are maintained in a substantially parallel, spaced apart relationship to one another. Furthermore, strips 5, 5*a* not only protect getter elements 10 from being damaged from the outside, but also thermally insulate getter elements 10 to minimize heat loss from heating member 20, which is mounted longitudinally and orthogonally with respect to the planes defined by getter elements 10, and thereby help maintain getter elements 10 at their optimum operating temperature. In this regard, the frame, which by virtue of its U-shape encloses heating member 20, e.g., an infrared lamp, on three sides (the fourth side being the getter elements), also helps to maintain the getter elements at their optimum temperature by serving as an effective thermal shield for preventing heat losses to the outside and by directing, e.g., by reflection, a maximum amount of radiation from the infrared lamp onto the getter elements.

If desired, the stability and rigidity of the getter pump may be increased by fastening stiffening strips 9 transversely to sidewalls 3, 3*a*, as can best be seen in FIG. 2*b*. This may be accomplished by first folding strips 9 along folding lines 12, then placing strips 9 transversely across sidewalls 3, 3*a* at spaced apart locations, e.g., end, middle, end, such that square sections 15 at the ends thereof are adjacent to sidewalls 3, 3*a*, and finally spot welding square sections 15 to the respective sidewalls 3, 3*a* (as noted above the locations of the spot welds are indicated by an * in FIG. 2*a*). The use of stiffening strips 9 is advantageous because it helps maintain the geometric characteristics and tolerances of the getter pump and makes the getter pump easier to transport.

The getter pump shown in FIGS. 2*a* and 2*b* provides several significant advantages. For example, this getter pump is easy to assemble because it uses a one-piece frame and does not require any complicated mechanical assemblies to ensure that the getter elements are securely aligned in the desired geometrical configuration. The configuration of this getter pump also provides the desirable characteristics of compactness, reliability, portability, and improved thermal insulation.

Figure 3:
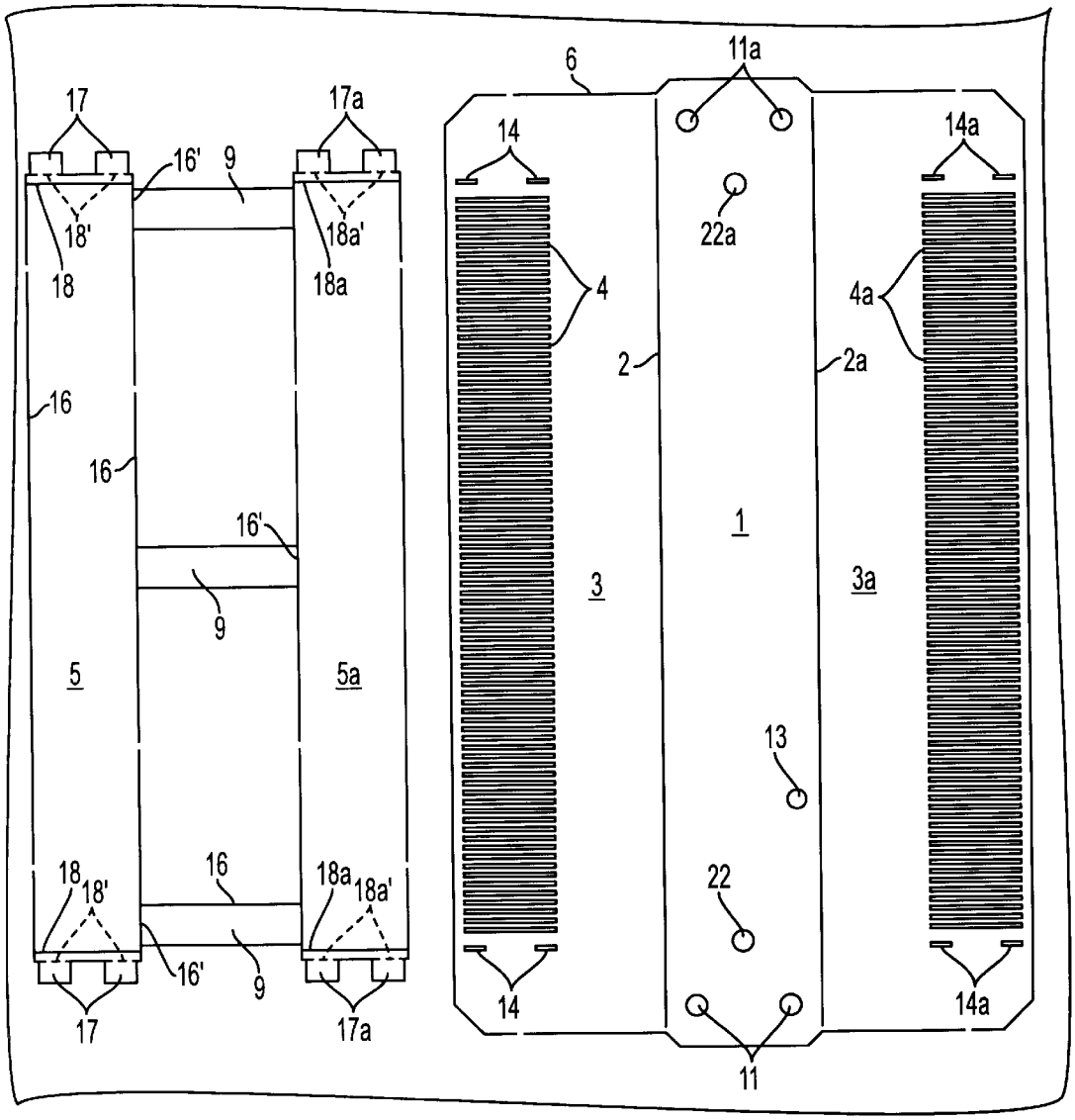
FIG. 3 shows a second preformed sheet of metal having slots, holes, folding lines, and cut lines formed therein for obtaining a getter pump in accordance with another embodiment of the invention.

FIG. 3 shows a second preformed sheet of metal for use in forming components of a getter pump in accordance with another embodiment of the invention. As will be explained in detail in the following discussion, a getter pump may be assembled using the preformed sheet shown in FIG. 3 without employing welding operations. For sake of brevity, the description of the reference numerals shown in FIG. 3 which have been previously discussed in connection with the description of FIG. 1 will not be repeated. With reference to FIG. 3, a pair of openings 14 is provided at each end of strip 3 adjacent to the last slot 4 at each end. A pair of openings 14*a* is similarly provided at each end of strip 3*a* adjacent to the last slot 4*a* at each end. In addition, openings 22, 22*a* for fastening members 21, 21' (not shown in FIG. 3), which support heating member 20, may be provided in middle strip 1 as indicated. As in the preformed sheet shown in FIG. 1, the preformed sheet shown in FIG. 3 includes strips 5, 5*a*; however, in this alternative embodiment strips 5, 5*a* have two protruding tangs 17, 17*a*, respectively, at each end thereof. Tangs 17 are separated from each end of strip 5 by a pair of oppositely directed folding lines 18, 18'. Similarly, tangs 17*a* are separated from each end of strip 5*a* by a pair of oppositely directed folding lines 18*a*, 18*a'*. As noted above, the dashed lines indicate folding lines formed in the hidden, i.e., bottom, surface of the sheet.

Further, and with continuing reference to FIG. 3, strips 5, 5*a* are joined together by three transverse strips 9 which are integrally formed with strips 5, 5*a*. In this alternative embodiment, discontinuous perforation 16 is provided along the entire outline of strips 5, 5*a* including tangs 17, 17*a*. As described above for perforation 6 in connection with the description of FIG. 1, perforation 16 is interrupted by breakaway tabs which connect strips 5, 5*a* to the remainder of the sheet. Perforation 16 is also provided along the perimeter of the two rectangles defined by the inner portions of strips 5, 5*a* and strips 9. Finally, folding lines 16' are provided at the point where strips 9 intersect strips 5, 5*a*, to enable such strips to be folded approximately 90° relative to strips 9.

Figure 4A:
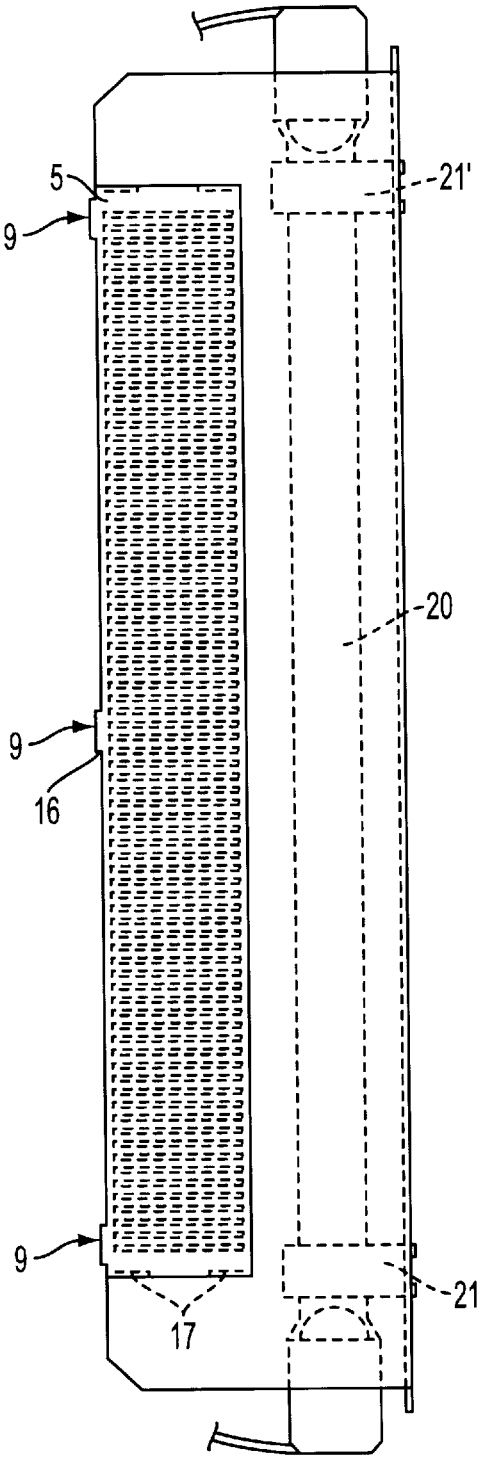
FIG. 4*a* shows a side view of a getter pump in accordance with another embodiment of the invention obtained from the preformed sheet of metal shown in FIG. 3.
Figure 4B:
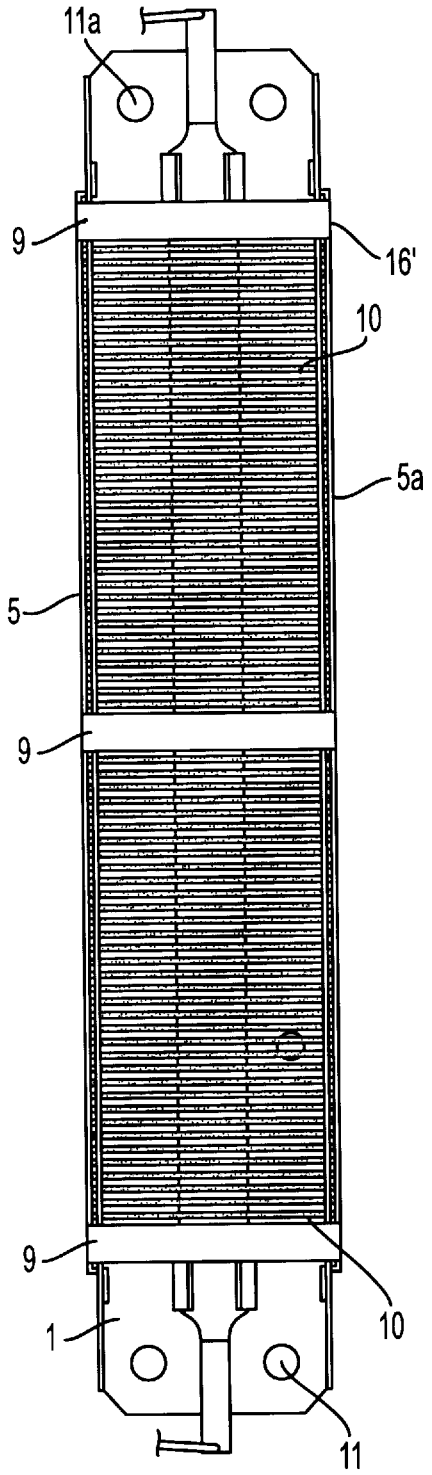
FIG. 4*b* shows a top plan view of a getter pump in accordance with another embodiment of the invention obtained from the preformed sheet of metal shown in FIG. 3.

FIGS. 4*a* and 4*b* show side and top views, respectively, of a getter pump formed in accordance with another embodiment of the invention using the preformed sheet of metal shown in FIG. 3. The getter pump shown in FIGS. 4*a* and 4*b* may be assembled in substantially the same manner described above for the getter pump shown in FIGS. 2*a* and 2*b*, with the exception that strips 5, 5*a* may be fastened to sidewalls 3, 3*a*, respectively, without spot welding as follows.

Starting with the substantially U-shaped frame formed by folding strips 3, 3*a* to form sidewalls in the manner described above in connection with the description of FIGS. 2*a* and 2*b*, one of strips 5, 5*a* is fastened to the outer surface of one of sidewalls 3, 3*a*. By way of example, to fasten strip 5 to sidewall 3, strip 5 is first folded along folding lines 16' at about a 90° angle relative to stiffening strips 9 and then end tangs 17 of strip 5 are inserted in respective openings 14 formed in sidewall 3. The short segments between opposing folding lines 18, 18' at the ends of strip 5 allow strip 5 to held substantially parallel to and spaced apart from sidewall 3 by a distance equal to slightly more than one-half the difference between the width of getter elements 10 and the width of the bottom of the frame, i.e., the width of middle strip 1. Getter elements 10 are then inserted in slots 4, 4*a* of sidewalls 3, 3*a* in the manner described above. By way of example, if strip 5 is first fastened to sidewall 3, then getter elements 10 are first inserted in slots 4*a* of sidewall 3*a* and then into corresponding slots 4 of sidewall 3. Once all the slots 4, 4*a* are filled with getter elements 10, strip 5*a* is fastened to sidewall 3*a*. This may be accomplished by first folding strip 5*a* along folding lines 16' at about a 90° angle relative to stiffening strips 9 and then inserting end tangs 17*a* of strip 5*a* in respective openings 14*a* formed in sidewall 3*a*. It will be apparent to those skilled in the art that at the same time strips 5, 5*a* are fastened to sidewalls 3, 3*a*, respectively, stiffening strips 9, which are integrally formed with strips 5, 5*a*, are transversely placed across sidewalls 3, 3*a* at the ends and middle thereof. As discussed above, stiffening strips 9 increase the stability and rigidity of the getter pump and thereby ensure that the geometric characteristics of the pump are reliably maintained.

The getter pump shown in FIGS. 4*a* and 4*b* provides the same advantages and the same desirable characteristics as described above for the getter pump shown in FIGS. 2*a* and 2*b* but does not require spot welding. Thus, the getter pump shown in FIGS. 4*a* and 4*b* provides the further advantage that it is capable of being assembled with only quick and simple manual operations, at the cost of a slightly higher consumption of material relative to that of the getter pump shown in FIGS. 2*a* and 2*b*. In addition, the getter pump shown in FIGS. 4*a* and 4*b* is easily portable because it is capable of being disassembled and reassembled by simple manual operations without requiring the use of destructive operations to separate parts which have been welded together.

In another aspect of the invention, a method of forming a getter pump component is provided. In this method, a preformed sheet of metal having a getter pump component defined therein by discontinuous perforations is first provided. Suitable preformed sheets of metal, e.g., stainless steel, include, but are not limited to, those shown in FIGS. 1 and 3 herein. Thus, by way of example, the sheet may have one or more of a frame section, strips to be fastened to the frame section, or stiffening strips to be fastened transversely to the frame section defined therein. As explained above, the getter pump component defined in the sheet by the discontinuous perforations is connected to the remainder of the sheet by breakaway tabs. Further, the getter pump component preferably has at least one folding line formed therein such as, for example, folding lines 2, 2*a* formed in the frame section including strips 1, 3, and 3*a* shown in FIG. 1, to enable the component to be folded into a desired shape. As described above, such folding lines may be formed by any suitable known technique, preferably by a controlled etching process which removes only a portion, e.g., one-half, of the thickness of the sheet.

Next, the getter pump component is detached from the sheet, e.g., by applying manual force to break the breakaway tabs connecting the getter pump component to the remainder of the sheet. Finally, the detached getter pump component is folded along the at least one folding line to obtain the desired shape. For example, as described in detail above, the frame section detached from the sheet illustrated in FIG. 1, which includes middle strip 1 and side strips 3, 3*a*, is folded along folding lines 2, 2*a* to obtain a substantially U-shaped frame having bottom 1 and opposing sidewalls 3, 3*a*.

While this invention has been described in terms of several preferred embodiments, there are alterations, permutations, and equivalents which fall within the scope of this invention. If should also be noted that there are many ways of implementing the getter pump, the method of forming a getter pump component, and the preformed sheet of metal for use in forming at least one component of a getter pump of the present invention. It is therefore intended that the following claims be interpreted as including all such alterations, permutations, and equivalents as fall within the true spirit and scope of the present invention.

What is claimed is:

1. A getter pump, comprising:

a frame having a bottom, a first sidewall, and a second sidewall opposing said first sidewall, said first and second sidewalls having a plurality of slots formed therein;

a plurality of getter elements housed in said frame, each of said getter elements being disposed in one of said slots in said first sidewall and a corresponding slot in said second sidewall; and a heating member for heating said getter elements disposed within said frame.

2. The getter pump of claim 1, wherein the getter elements are substantially parallel to one another.

3. The getter pump of claim 1, wherein the getter elements are rectangular plates of nonevaporable getter material and the slots formed in the first and second sidewalls have a rectangular shape configured to receive the getter elements.

4. The getter pump of claim 3, further comprising a first contoured strip for at least partially shielding exposed sides of the getter elements protruding through the slots in the first sidewall, said first contoured strip being fastened to an outer surface of the first sidewall, and a second contoured strip for at least partially shielding exposed sides of the getter elements protruding through the slots in the second sidewall, said second contoured strip being fastened to an outer surface of the second sidewall.

5. The getter pump of claim 4, further comprising at least one stiffening strip fastened transversely to the first and second sidewalls.

6. The getter pump of claim 1, wherein the heating member is an infrared lamp.

7. The getter pump of claim 6, wherein the infrared lamp is mounted on the bottom of the frame.

8. The getter pump of claim 1, wherein the frame is comprised of stainless steel.

9. A getter pump, comprising:

a one-piece, substantially U-shaped frame having a bottom, a first sidewall extending upwardly from said bottom, and a second sidewall extending upwardly from said bottom and opposing said first sidewall, said first and second sidewalls being formed by folding a single metal sheet along a pair of spaced apart folding lines formed in said sheet, and said first and second sidewalls having a plurality of substantially parallel slots formed therein;

a plurality of getter elements housed in said frame, each of said getter elements being a rectangular plate of nonevaporable getter material and being disposed in one of said slots in said first sidewall and a corresponding slot in said second sidewall such that said getter elements are substantially parallel to one another, said getter elements having a length larger than a width of said bottom of said frame so that sides of said getter elements protrude through said slots in said first and second sidewalls;

a first contoured strip for at least partially shielding exposed sides of said getter elements protruding through said slots in said first sidewall, said first contoured strip being fastened to an outer surface of said first sidewall;

a second contoured strip for at least partially shielding exposed sides of said getter elements protruding through said slots in said second sidewall, said second contoured strip being fastened to an outer surface of said second sidewall; and a heating member for heating said getter elements disposed within said frame.

10. The getter pump of claim 9, wherein the first and second contoured strips each have integrally stepped ends.

11. The getter pump of claim 10, wherein the integrally stepped ends of the first contoured strip are spot welded to the first sidewall, and the integrally stepped ends of the second contoured strip are spot welded to the second sidewall.

12. The getter pump of claim 9, wherein ends of the first contoured strip have protruding tangs inserted in openings in the first sidewall, and ends of the second contoured strip have protruding tangs inserted in openings in the second sidewall.

13. The getter pump of claim 11, further comprising at least one stiffening strip fastened transversely to the first and second sidewalls.

14. The getter pump of claim 12, wherein at least one stiffening strip is integrally formed with the first and second contoured strips, said at least one stiffening strip extending transversely between the first and second contoured strips and having folding lines formed therein, the first and second contoured strips being folded along said folding lines.

15. The getter pump of claim 9, wherein the heating member is an infrared lamp.

16. The getter pump of claim 15, wherein the infrared lamp is mounted on the bottom of the frame.

17. The getter pump of claim 9, wherein the frame and the first and second contoured strips are comprised of stainless steel.

* * * * *